United States Patent [19]

Pierre

[11] 4,423,574

[45] Jan. 3, 1984

[54] INSULATING PANEL FOR THERMAL OPENINGS

[76] Inventor: Jacquilyn L. Pierre, 8780 42nd St., North, Lake Elmo, Minn. 55042

[21] Appl. No.: 304,688

[22] Filed: Sep. 22, 1981

Related U.S. Application Data

[63] Continuation of Ser. No. 198,656, Oct. 20, 1980, abandoned.

[51] Int. Cl.[2] ..... E06B 3/26

[52] U.S. Cl. ..... 52/202; 52/213; 52/509; 49/63

[58] Field of Search ..... 52/202, 509-512, 52/127, 211, 213; 428/160; 211/13; 312/250; 280/651; 49/63

[56] References Cited

U.S. PATENT DOCUMENTS

| | | | |
|---|---|---|---|
| 370,697 | 10/1887 | McNutt | 312/250 |
| 475,948 | 5/1892 | Pease | 211/13 |
| 1,000,551 | 8/1911 | Pickett | 16/106 |
| 1,399,351 | 12/1921 | Lee | 280/79.3 |
| 1,613,017 | 1/1927 | Buss | 52/213 |
| 2,346,769 | 4/1944 | Lichtor | 52/509 |
| 2,409,951 | 10/1946 | Nootens | 52/782 |
| 3,192,099 | 6/1965 | Beckman et al. | 428/160 |
| 3,226,899 | 1/1966 | Blickle | 52/127 |
| 3,282,004 | 11/1966 | Brounn | 52/509 |
| 3,832,812 | 9/1974 | Hiatt | 52/127 |
| 4,044,511 | 8/1977 | Lingle | 52/127 |
| 4,057,936 | 11/1977 | Wyatt | 49/61 |
| 4,068,428 | 1/1978 | Peterson | 52/202 |
| 4,115,953 | 9/1978 | Brosenius | 49/125 |
| 4,242,836 | 1/1981 | Anderson | 49/63 |
| 4,267,666 | 5/1981 | Davidson | 49/63 |
| 4,272,934 | 6/1981 | Cowden et al. | 52/202 |

FOREIGN PATENT DOCUMENTS

| | | | |
|---|---|---|---|
| 581402 | 9/1924 | France | 280/79.3 |

*Primary Examiner*—James L. Ridgill, Jr.

*Attorney, Agent, or Firm*—Schwartz, Jeffery, Schwaab, Mack, Blumenthal & Koch

[57] ABSTRACT

The panel comprises a sheet of opaque insulating material having height and width dimensions greater than similar dimensions of the opening to be covered such that the panel can completely cover the opening and overlap the edges thereof. A covering material is connected to the sheet along a major surface and along its edges to provide structural rigidity and to enhance the appearance of the panel. Connectors are attached to the top and bottom edges of the sheet in order to connect the panel over the thermal opening. In one embodiment, the covering comprises a wood frame around the sheet and a wooden board attached to the frame. The connectors can comprise hook and eyelet connectors, snap fasteners or the like. Additionally, a fastener such as a hook and pile fastener can be attached around the periphery of the panel to promote an airtight seal. Storage elements for the panels are also disclosed.

8 Claims, 10 Drawing Figures

INSULATING PANEL FOR THERMAL OPENINGS

CROSS REFERENCE TO RELATED APPLICATIONS

This is a Continuation of U.S. application Ser. No. 198,656, filed Oct. 20, 1980, now abandoned.

BACKGROUND OF THE INVENTION

1. Field of the Invention

This invention relates to devices for conserving energy by completely enclosing thermal openings such as doors, windows or the like in building structures.

2. Discussion of Related Art

As energy supplies become more scarce, the difficulties in heating homes in northern climates continue to increase. Consequently, the need for providing adequate insulation for homes and other building structures is quite apparent. One of the major sources of heat loss in a building is through thermal openings such as doors, windows and the like. Even with storm windows attached, the windows of a building produce a relatively large heat loss with respect to insulated walls of the building. Thus, it would be beneficial to have an apparatus by which the thermal openings can be completely covered especially during periods of severe cold weather. At the same time, the apparatus should be easily removable from the thermal openings so that during sunny periods, the benefit of solar radiation can be achieved by letting the sun shine through the thermal openings. When not used for covering thermal openings, a convenient storage rack should also be provided.

U.S. Pat. No. 4,057,936 to William Burk Wyatt, Jr., et al discloses a panel for insulating a window or door. The panel is apparently permanently mounted in position in the manner of a storm window.

U.S. Pat. No. 4,068,428 to O. James Peterson, III, discloses the use of hook and pile fastening elements for fastening a window made of transparent rigid plastic over a window for insulating purposes.

However, these and other known devices do not provide adequate insulation or are difficult to use or store. Therefore, the need for a more useful insulating panel remains.

SUMMARY OF THE INVENTION

One object of the present invention is to provide a panel for insulating thermal openings which can easily be mounted to a thermal opening during cold weather periods and can be removed and stored to obtain the benefit of solar radiation heating during "sun hours".

A further object of the present invention is to provide a panel for insulating a thermal opening, which panel not only provides insulation but also can be made to be attractive when in use to enhance the appearance of a room being insulated.

A further object of the present invention is to provide a means for conveniently storing panels when they are not in use.

An even further object of the present invention is to provide a panel and means for storing the panel which are relatively inexpensive to manufacture yet durable and effective in use.

In accordance with the above and other objects, the present invention is an insulating panel for thermal openings which comprises a sheet of opaque insulating material which can be, for example, styrofoam or other expanded foam material. The insulating sheet has dimensions which are greater than the dimensions of the opening it is to cover so that it will overlap the edges of the opening. A covering is connected to the sheet which can be, for example, oil cloth, wood or the like. The covering provides additional support for the sheet and also can be used to imprint an attractive design or color scheme on the panel. Connectors are attached along the top and bottom edges of the panel for attaching it over the thermal opening. Typically, the connectors along the top would be in the form of hook and eyelet connectors so that the panel can be hung easily. The connectors along the bottom would typically be snap fasteners used to hold the panel tightly against the opening.

Additional features of the invention include the formation of holes in the panel to accept protrusions such as crank handles on the thermal opening. The holes are covered with soft, flexible insulating material which will conform to the shape of the protrusions yet maintain the insulating properties of the panel.

Another feature of the present invention resides in the use of an insulating strip around the periphery of the panel to ensure an airtight seal. Also, a fastener such as a hook and pile fastener can be attached around the periphery to promote a good seal.

The present invention also includes an apparatus for storing the panels when not in use. In one embodiment, the apparatus takes the form of a cart having caster wheels and a plurality of horizontal channel members. Panels which are supplied with hooks for hanging over the thermal openings can be hung directly from the channels on the cart. When the cart is filled, it can be transported to a convenient location for storage. Alternatively, if the panels are provided with eyelet type hanging elements, the storage apparatus takes the form of elongated hooks over which the eyelets may be passed for storage. The elongated hooks may also be disposed on a cart or can be attached to a wall.

BRIEF DESCRIPTION OF THE DRAWINGS

The above and other objects of the present invention will become more readily apparent as the invention is more fully described in the detailed description, reference being had to the accompanying drawings in which like reference numerals represent like parts throughout, and in which.

DETAILED DESCRIPTION OF THE PREFERRED EMBODIMENT

Figure 1:
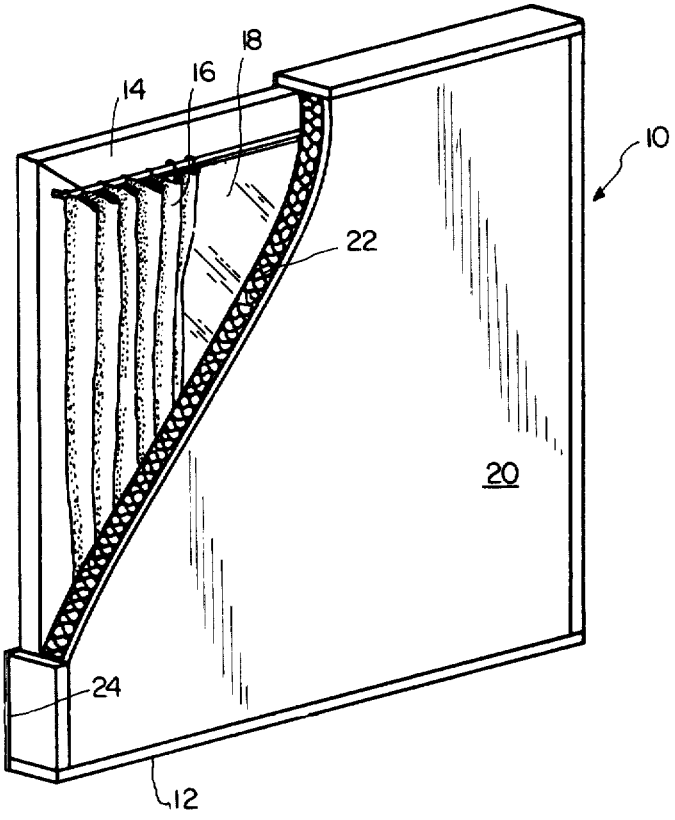
FIG. 1 is a perspective view of a first embodiment of the panel of the present invention with portions broken away to show the panel construction.
Figure 2:
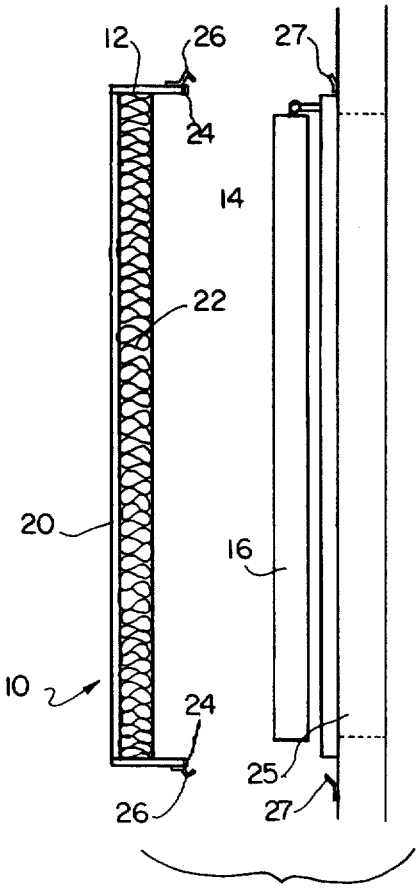
FIG. 2 is an elevational sectional view of the panel of FIG. 1.

FIGS. 1 and 2 show a first embodiment of the thermal panel generally designated by the reference numeral 10. Panel 10 is used to cover a thermal opening such as window 18. Window 18 comprises a glass pane surrounded by a window frame 14 of conventional construction. Frame 14 is, of course, attached to wall 25 of the building. A curtain 16 is hung by conventional drapery hooks or the like over the window. Panel 10 is designed to cover and surround the entire window assembly including window frame 14 and curtain 16.

Panel 10 includes an insulating sheet 22 which can be any conventional insulating material such as styrofoam or other expanded foam material. Preferably, sheet 22 has a thickness of approximately three inches or more to provide adequate insulation for the opening. As can be seen, sheet 22 has height and width dimensions which are greater than the height and width dimensions of window 18 so that the sheet overlaps completely the entire glass pane and window frame 14. The sheet 22 is surrounded by a frame 12 which comprises four boards attached at their corners. Each of the boards has a width which is greater than the thickness of sheet 22 so that frame 12 extends toward the thermal opening sufficiently to overlap frame 14 and abut wall 25 leaving room between the sheet 22 and wall 25 to accommodate curtain 16. In this manner, the panel 10 can be attached over the thermal opening without the need for removing the curtain or other items hanging in the window. A board 20 is bonded to the exposed side of the panel and connects around its periphery to frame 12. Board 20 can be pressed wood, plywood or the like. The framework and board 20 comprise a covering for sheet 22 which both ensures the structural integrity of the panel and provides a smooth surface on which a design or color scheme can be imprinted to provide aesthetic appeal to the panel.

The mounting structure includes a downwardly opening aluminum channel 26 mounted to the edge of frame 12 along the top of the frame such that a free edge of the channel extends over the frame. The edge of channel 26 is hung on offset clip 27 mounted to wall 25. Accordingly, panel 10 can be hung from clip 27 and, by adjusting the position of channel 26 on frame 12, it can be assured that frame 12 will rest against wall 25. A similar channel 26 is mounted on the bottom portion of the frame in an upwardly opening position. The channel is V-shaped and mates with a second offset clip 27 also mounted to wall 25. The bottom of upwardly opening channel 26 slides into clip 27 to hold the bottom portion of panel 10 in position. In order to ensure an airtight seal between panel 10 and wall 25, a strip of insulation 24, which may be a flexible, expanded foam material with an adhesive backing, is applied along the inner edge of frame 12. Accordingly, when panel 10 is hung in position, insulating strip 24 will be pressed against the wall.

Figure 3:
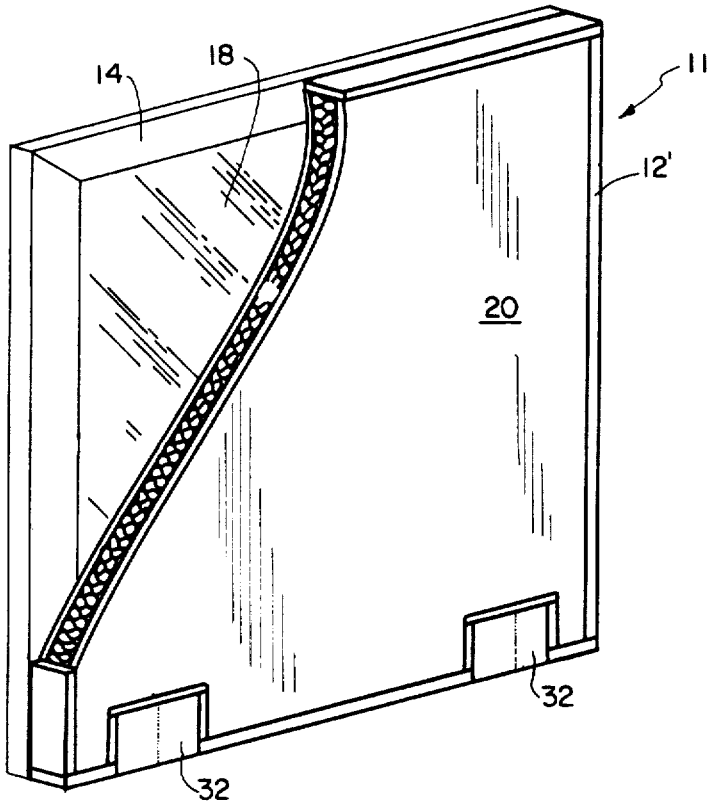
FIG. 3 is a perspective view of a second embodiment of the panel of the present invention with portions broken away to show the panel construction.
Figure 4:
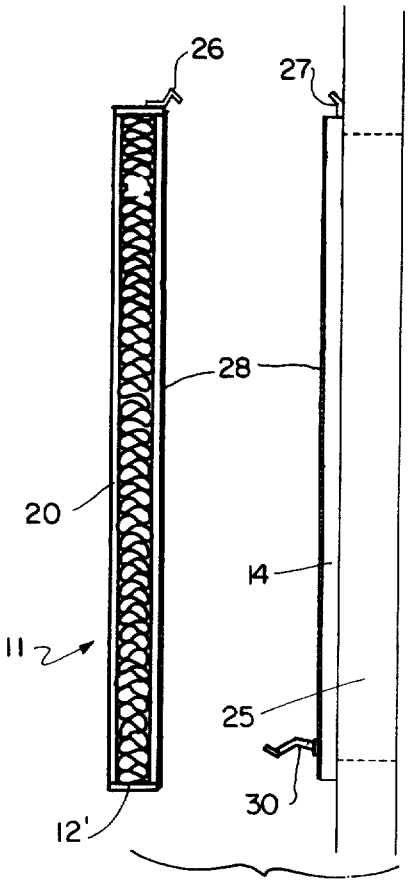
FIG. 4 is an elevational sectional view of the panel of FIG. 3.

A second embodiment of the panel is shown in FIGS. 3 and 4 and generally designated by the reference numeral 11. Panel 11 is similar to panel 10 except that panel 11 is designed to accommodate protrusions from the thermal opening such as doorknobs, crank handles or the like. Panel 11 includes a sheet of insulation 22 surrounded by a framework 12' and covered with a layer of wood 20. Panel 11 also differs from panel 10 in that it is designed to rest directly against the window frame 14 and does not provide space to accommodate a curtain or the like. For this reason, frame 12' has a width which is only sufficiently greater than the thickness of insulation 22 to meet with board 20. Frame 12' also is interrupted along its lower edge to accommodate expandable areas 32. Expandable areas 32 comprise holes which extend through the insulation 22 and board 20. A soft, flexible insulating foam is disposed in the holes. In this manner, a protrusion such as crank 30 will be forced into the soft foam so that panel 11 can rest against frame 14 with no disruption of the sealing and insulating effects of the panel. A downwardly opening channel 26 and offset clip 27 are used to hang the panel from its top edge on wall 25. In view of the force produced by crank 30, it is desirable that the panel be mounted to the thermal opening along its entire peripheral edge. For this purpose, a hook and pile fastener 28, such as "velcro" is used. One strip of the hook and pile fastener is attached to the inner peripheral edge of frame 12' while the mating strip of the fastener is secured to window frame 14. The fastener ensures that a relatively airtight seal is maintained between panel 11 and the thermal opening. Of course, strips of foam insulation can be disposed alongside the velcro to further enhance the sealing effect.

Figure 5:
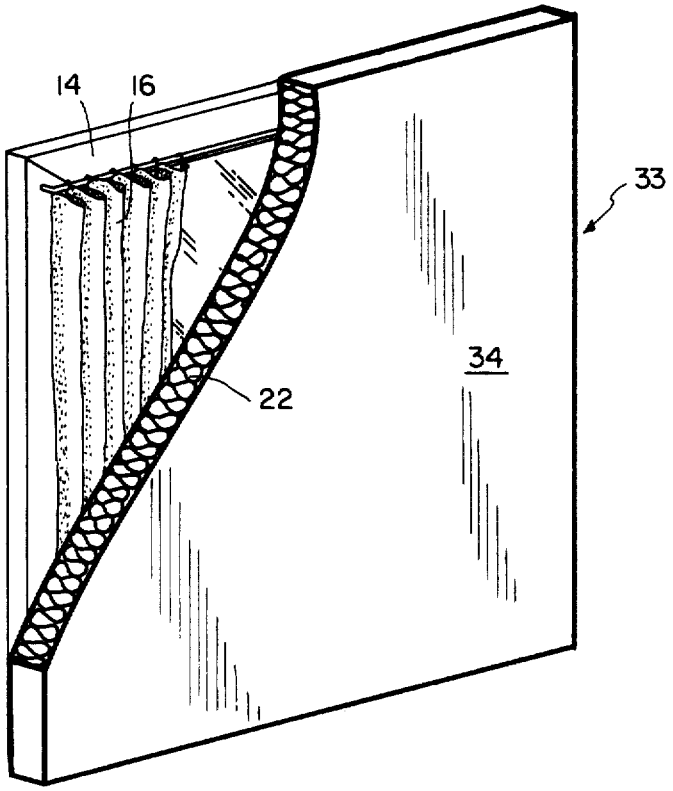
FIG. 5 is a perspective view of a third embodiment of the panel of the present invention with portions broken away to show the panel construction.
Figure 6:
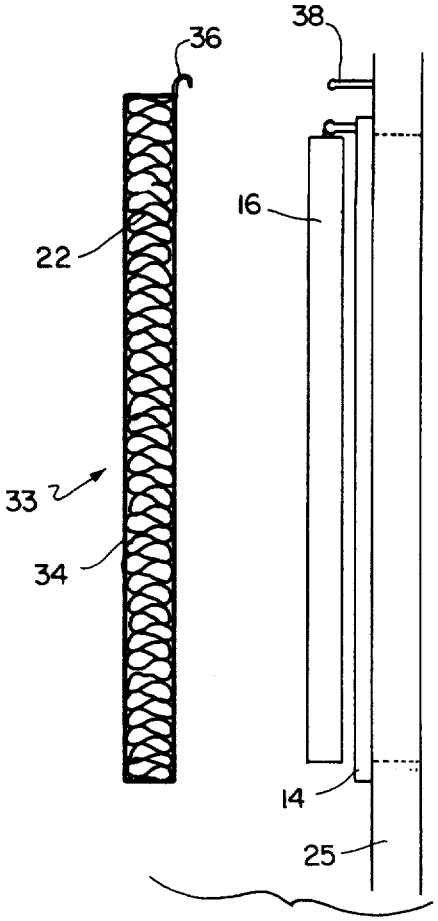
FIG. 6 is an elevational sectional view of the panel of FIG. 5.

FIGS. 5 and 6 show a third embodiment of the panel of the present invention generally designated by the reference numeral 33. Panel 33 is designed to be used where the thermal opening benefits from a free-hanging insulated covering such as insulated drapes 16. Drapes 16 provide a measure of insulation to the window and this insulation is supplemented by panel 33.

Panel 33 is similar to the previously described panels in that it contains a sheet of insulating material 22. Insulating sheet 22 is covered by a soft but heavy covering material such as oil cloth 34. The oil cloth 34 is easy to clean, decorate and redecorate, when desired. The oil cloth can be bonded to the insulating sheet 22 in order to provide structural integrity to the panel. Panel 33 is attached to wall 25 by the use of heavy drape hooks 36 which can be inserted directly into the insulating sheet 22. The drape hooks 36 are hung on a standard drape hook wall mount 38 which matches and holds the hooks and panel 33. Panel 33 is allowed to hang freely and rest against curtain 16 forcing the curtain more tightly against the thermal opening. It will be noted that hooks 36 are disposed on the inner upper edge of panel 33 which causes the panel to angle slightly inwardly forcing curtain 16 against the thermal opening.

Figure 7:
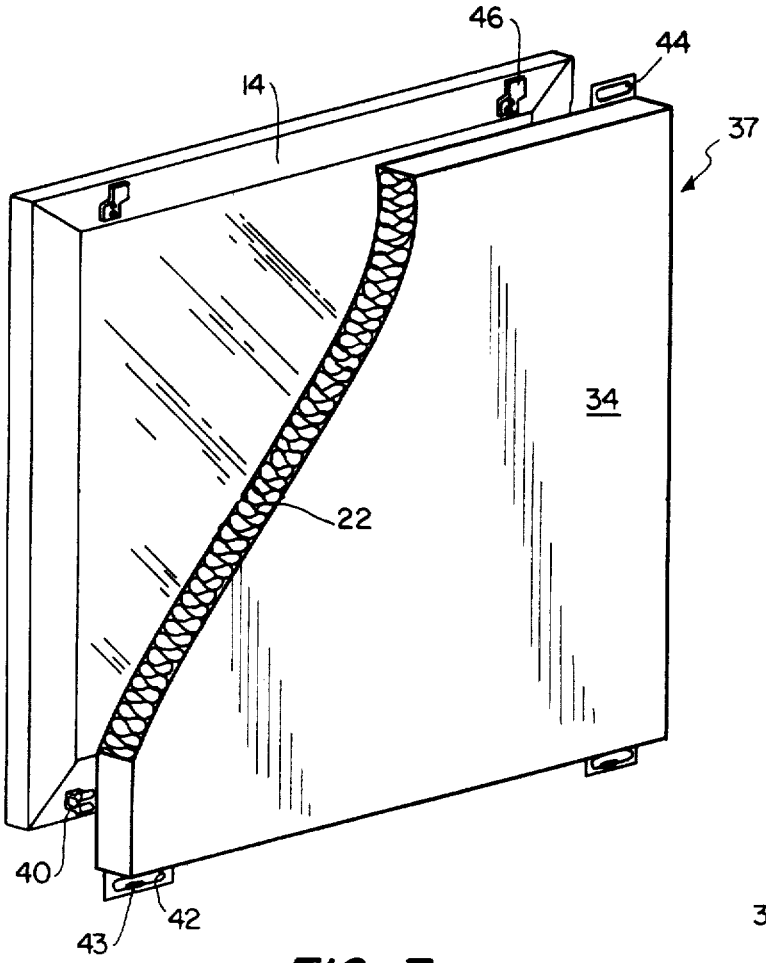
FIG. 7 is a perspective view of a fourth embodiment of the panel of the present invention with portions broken away to show the panel construction.
Figure 8:
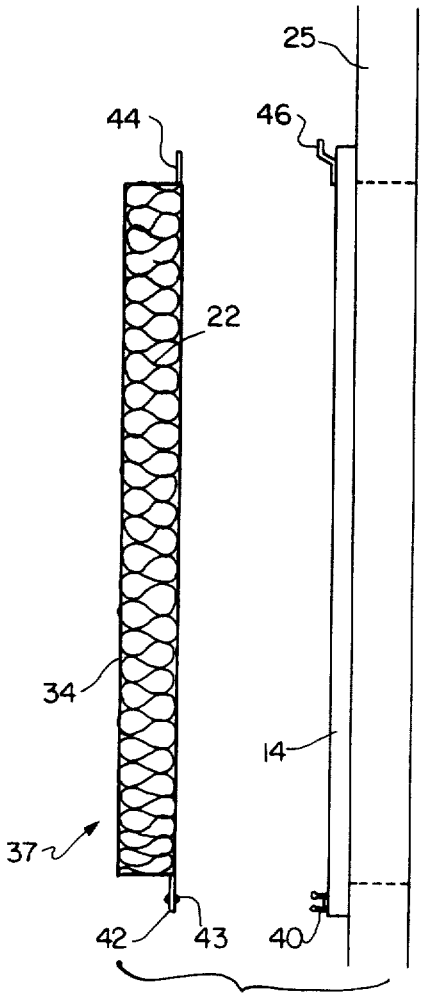
FIG. 8 is an elevational sectional view of the panel of FIG. 7.

FIGS. 7 and 8 show a fourth embodiment of the panel generally referred to by the reference numeral 37. Panel 37 is similar to panel 33 in that it contains insulating sheet 22 covered by oil cloth 34. However, the attachment mechanism for panel 34 is somewhat different. Panel 34 includes eyelets or handles 44 which are attached to the inner, upper peripheral edge of the panel. Handles 44 can be disposed over offset clips 46 which are attached to window frame 14 for hanging the panel from the window frame. At the bottom inner peripheral edge, additional handles 42 are included having enlarged areas 43 formed thereon. The handles 42 are received in resilient clips 40 mounted to window frame 43. The enlarged areas 43 snap between a pair of projections on resilient clip 40 to pull the panel snugly in place over the thermal opening.

It should be understood that the various features of the aforedescribed embodiments of the panel of the present invention can be interchanged as needed to be used on various thermal openings. Also, it should be clearly understood that the panels can be used with thermal openings other than windows; the use of the panels on windows was described for convenience only. Other thermal openings include windows on doors, door openings themselves, or the like.

Figure 9:
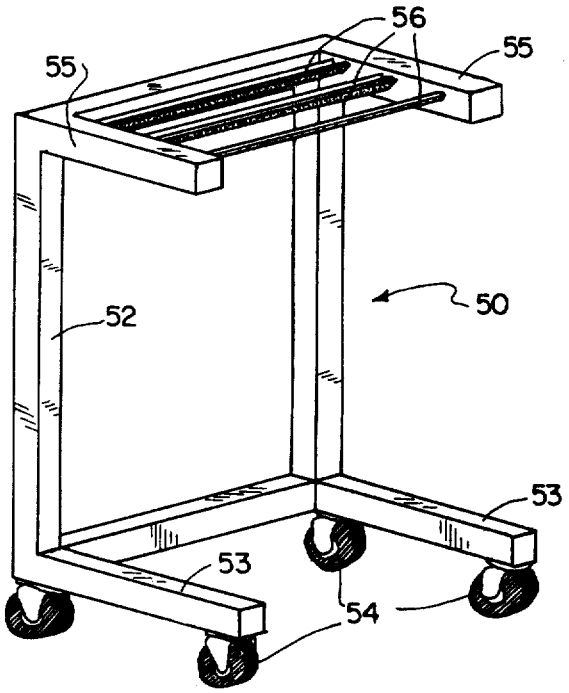
FIG. 9 is a perspective view of the storage cart of the present invention.

As described above, one of the major features of the panel of the present invention is the ability of the user to conveniently attach the panel to a thermal opening during severe weather conditions and to remove the panel at times when the sun's rays may enter a window or other thermal opening to take advantage of solar radiation effects. At these times, it is necessary to conveniently store removed panels. For this purpose, a storage rack 50 shown in FIG. 9 is provided. Storage rack 50 includes a frame 52 having lower parallel frame members 53 to which are attached four caster wheels 54 so that the rack can be conveniently moved. Additional parallel frame members 55 are disposed over members 53. A plurality of V-shaped channel members 56 extend between frame members 55. Channel members 56 can conveniently receive the drape hooks 36 of panel 33 or the free edges of downwardly opening channel members 26 of panels 10 and 11 so that these panels may hang freely from channel members 36. Naturally, frame members 55 must be separated by a sufficient distance to accept the entire width of the panels to be stored on channel members 56. A sufficient number of channel members 56 may be used to accommodate as many panels as desired. Once the panels are hung from the channel members, the cart can be moved to a convenient storage location, such as a closet or the like.

Figure 10:
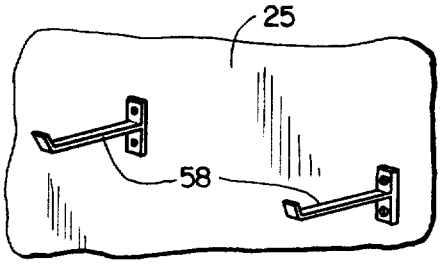
FIG. 10 is a perspective view of the elongated hook storage elements of the present invention.

FIG. 10 shows a pair of elongated hooks 58 which can be used to hang panel 37 from handles 44. Hooks 58 can be attached to wall 25 alongside of the thermal opening, if desired. Otherwise, hooks 58 can be attached to a cart similar to cart 50 so that the panels can be moved to a convenient storage location.

It should be understood that the foregoing is considered illustrative but not limitative of the present invention. Obviously, numerous modifications, additions or other changes can be made to the present invention without departing from the scope thereof as set forth in the appended claims.

What is claimed is:

1. In combination, a wall, a thermal opening formed in said wall, said thermal opening having a closure member mounted therein and surrounded by a closure member frame, a covering element such as a curtain hung over said closure member, and a panel for insulating said thermal opening, said panel comprising:

a single sheet of opaque insulating material having height and width dimensions greater than the height and width dimensions of said thermal opening such that said sheet completely covers said thermal opening and overlaps the edges of said thermal opening;

a covering material connected to said sheet at least along a major surface of said sheet to provide structural rigidity to said panel and to enhance the appearance of said panel;

a peripheral framework connected to the edges of said sheet and completely surrounding said sheet, said framework having a width substantially greater than the thickness of said sheet such that said framework extends beyond said sheet in a direction toward said thermal opening for providing space between said sheet and said thermal opening to accommodate said covering element; and connector means attached between said panel and said wall for removably hanging said panel over said thermal opening such that said framework contacts said wall completely around said thermal opening and holds said sheet at a distance spaced from said closure member by a sufficient distance to accommodate said covering element.

2. The combination as set forth in claim 1, wherein said insulating sheet includes at least one hole formd therein to surround the element protruding from said thermal opening, and a flexible insulating material disposed in said hole.

3. The combination as set forth in claim 1, wherein said covering comprises oil cloth.

4. The combination as set forth in claim 1, wherein said connector means comprises a downwardly opening channel attached to the inner top edge of said sheet, and an offset hook for attachment above said thermal opening.

5. The combination as set forth in claim 1, wherein said connector means includes snap fasteners attached to the inner bottom edge of said panel.

6. The combination as set forth in claim 1 and further including an insulating strip disposed about the inner peripheral edge of said panel.

7. The combination as set forth in claim 1 and further including a hook and pile fastener attached around the inner peripheral edge of said panel.

8. The combination as set forth in claim 1 and further in combination with a storage rack, said rack comprising a frame and a plurality of horizontal channels for hangingly receiving the connector means of said panel.

* * * * *